United States Patent [19]

Bentley

[11] Patent Number: 4,951,577

[45] Date of Patent: Aug. 28, 1990

[54] WALL SAFE ASSEMBLY

[76] Inventor: James K. Bentley, 3305 Starburst Ct., Bakersfield, Calif. 93309

[21] Appl. No.: 295,514

[22] Filed: Jan. 11, 1989

[51] Int. Cl.[5] ..... E05G 1/04

[52] U.S. Cl. ..... 109/51; 109/52; 70/58; 70/63

[58] Field of Search ..... 70/57, 58, 63, 232; 109/50–53, 54–57

[56] References Cited

U.S. PATENT DOCUMENTS

| | | | |
|---|---|---|---|
| 1,901,904 | 3/1933 | Ehrlich | 109/51 |
| 2,180,117 | 11/1939 | Lipsis | 109/51 X |
| 2,393,465 | 1/1946 | Gray | 109/51 X |
| 3,045,400 | 7/1962 | Grose | 109/52 X |
| 3,757,549 | 9/1973 | Mullis, Jr. | 70/58 X |
| 3,771,338 | 11/1973 | Raskin | 70/58 |
| 4,038,843 | 8/1977 | Daley, Jr. | 70/58 |
| 4,043,279 | 8/1977 | Padgett | 109/50 |
| 4,099,808 | 7/1978 | Oakley et al. | 109/50 X |
| 4,170,324 | 10/1979 | Stubbings | 70/58 X |
| 4,457,240 | 7/1984 | Hungerford | 109/50 X |
| 4,493,268 | 1/1985 | Sidler | 70/63 X |
| 4,579,311 | 4/1986 | Spranza, III | 70/58 X |
| 4,809,890 | 3/1989 | Tsigadas | 70/63 X |

*Primary Examiner*—Robert L. Wolfe

*Assistant Examiner*—Suzanne L. Dino

*Attorney, Agent, or Firm*—Charles C. Logan, II

[57] ABSTRACT

A wall safe assembly that is designed to be secured to a vertically oriented stud such as that positioned behind a sheet of drywall or paneling in the structure of a building. Generally the wall safe assembly would be mounted in a closet in one of its corners. The major components of the wall safe are the safe housing and the mounting block. The safe housing has a cylindrical configuration and it has a top wall or cover that is threadably received in the top end of the cylindrically shaped safe housing. An integrally formed ear extends horizontally from the bottom wall of the safe housing and also from the top wall. These ears are removably received in horizontal slots formed in the front wall of the mounting block. A pair of vertically spaced eye lag slots are also formed in the rear wall of the mounting block for receiving the ring portion of the heads of eye lags that have been screwed into the wall studs. A vertically oriented bore hole passes downwardly through the mounting block and it aligns with apertures formed in the ear members received in the horizontal slots and also with the ring part of said eye lags. A locking rod is dropped downwardly through the bore hole and the aligned apertures to secure the safe housing.

6 Claims, 2 Drawing Sheets

WALL SAFE ASSEMBLY

BACKGROUND OF THE INVENTION

The invention relates to a safe for storing personal valuables therein and more specifically to a safe that can be secured to the external surface of a wall in a closet.

One of the most serious problems the public at large now faces are breakins and the burglaries resulting therefrom. Some of the items most commonly taken are cash and jewelry. A considerable number of these burglars are not professional criminals, just juveniles or other persons trying to support a drug habit.

Another problem area for burglaries is in hotel and motel rooms. The burglaries involving these premises are often conducted by professional thieves and they execute their crime in a relatively short period of time.

It is an object of the invention to provide a novel wall safe assembly that can be secured to the corner studs in a closet so that it can not be ripped off the wall.

It is also an object of the invention to provide a novel wall safe assembly that can be utilized by hotel or motel guests in their closets.

It is another object of the invention to provide a novel wall safe assembly that is economical to manufacture and market.

It is an additional object of the invention to provide a novel wall safe assembly that can be easily installed, while still being designed so that it can not be ripped off the wall.

It is a further object of the invention to provide a novel wall safe assembly that would require the wall to be destroyed before the wall safe assembly could be removed therefrom.

SUMMARY OF THE INVENTION

Applicant's novel wall safe assembly has been designed as an economical safe that can be installed in a person's residence in a closet. Its unique structure lends itself to being utilized by hotels and motels in a closet in the rooms.

One of the basic strengths of the design of the novel wall safe assembly is the fact it cannot be removed once it is installed without physically destroying the wall to which it is mounted in the closet. Since most thieves work with a limited amount of time during a breakin, deterents that require a thief to spend extra time in a room generally deter the attempted robbery.

Ideally the mounting block of the wall safe assembly would be secured in one of the corners of a closet adjacent the floor of the closet. The mounting block itself has a pair of vertically spaced horizontally oriented apertures that pass from its front wall through to its rear wall. The front of the aperture is also countersunk so the screws that are utilized to fasten the mounting block to the corner studs of the closet are completely hidden after they are installed.

The safe housing has a cylindrical tubular shape and it would be preferably made of steel. Its bottom wall would be welded thereto and its top wall or cover would be threadably secured by screwing it into the internal threads at the top of the housing. Integrally formed with the bottom wall and the top wall are ear members that have aligned apertures therein. These are matingly received in horizontal slots in the front wall of the mounting block. A bore hole extends vertically down from the top wall of the mounting block all of the way to its bottom wall. Its top end is also counter sunk and a locking rod having a head on its top end is dropped downwardly through the aligned apertures in the ear members and the ring portions of the eye lags to securely lock the safe housing to the mounting block and to secure the mounting block to the eye lags. At the same time the housing will conceal the front of the apertures in the mounting block through which the fastening screws have been inserted. A notch is formed in the bottom wall of the mounting block for receiving a lock having a recess in its top surface that engages the knob member formed on the bottom end of the locking rod.

The safe housing has a cylindrical chamber therein which removably receives a tray assembly for keeping different valuables and jewelry therein. The tray assembly consists of a vertically extending tubular structure having a plurality of trays secured thereon at predetermined vertically spaced positions.

DESCRIPTION OF THE PREFERRED EMBODIMENT

Figure 1:
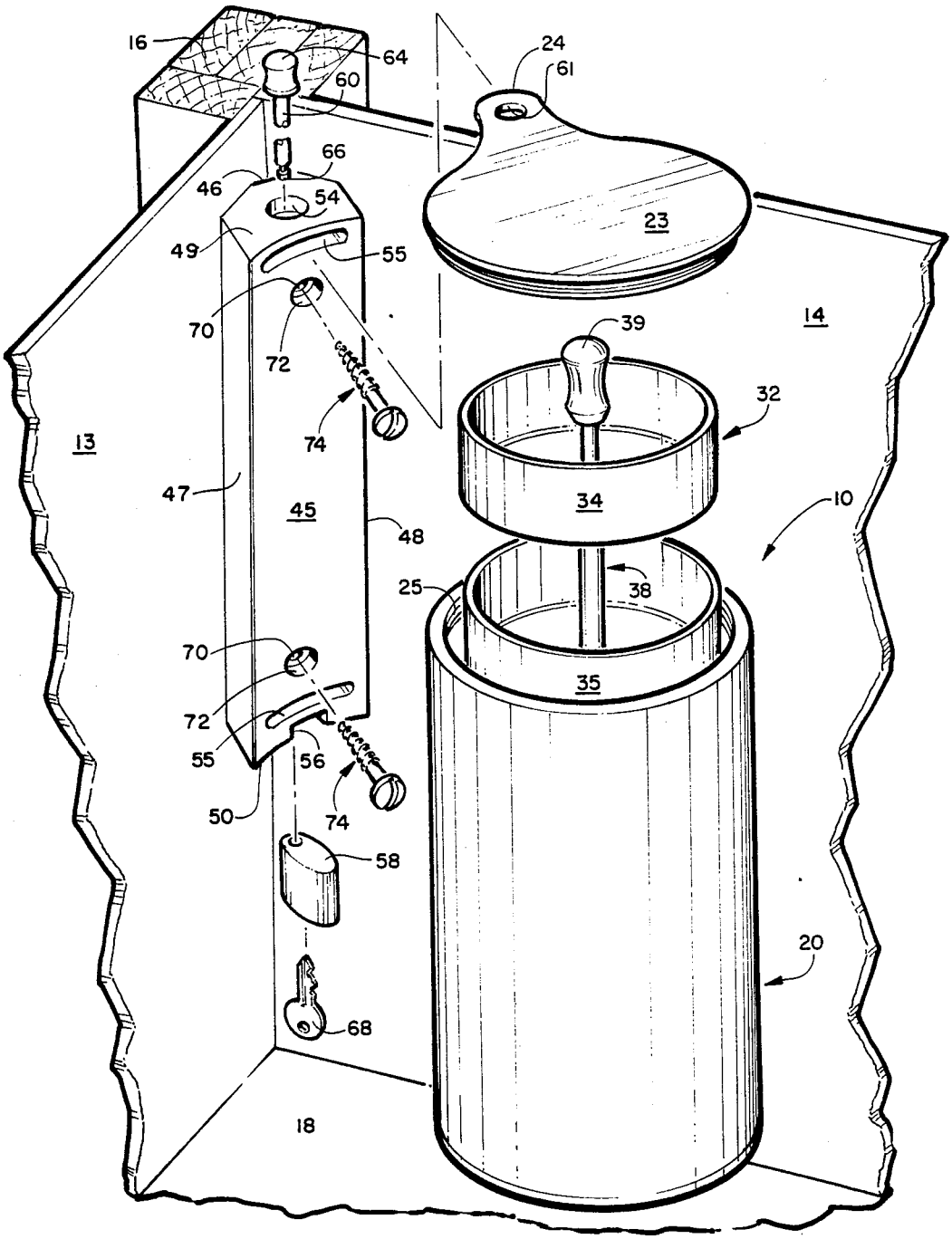
FIG. 1 is a front perspective view showing the wall safe assembly in exploded view and also the manner in which it is attached to the corner stud of a closet.
Figure 2:
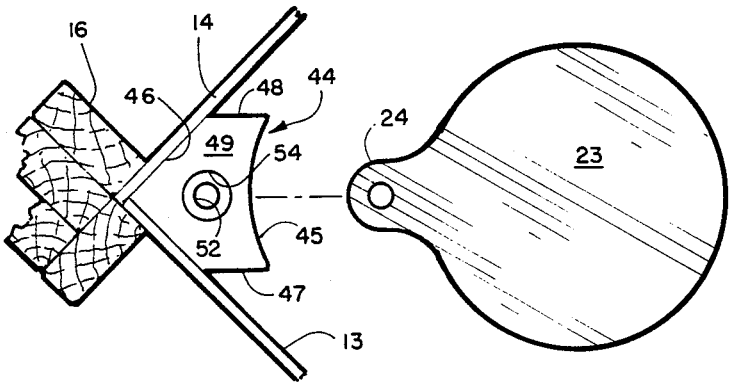
FIG. 2 is a top plan view illustrating the manner in which the safe housing is inserted into the mounting block.
Figure 3:
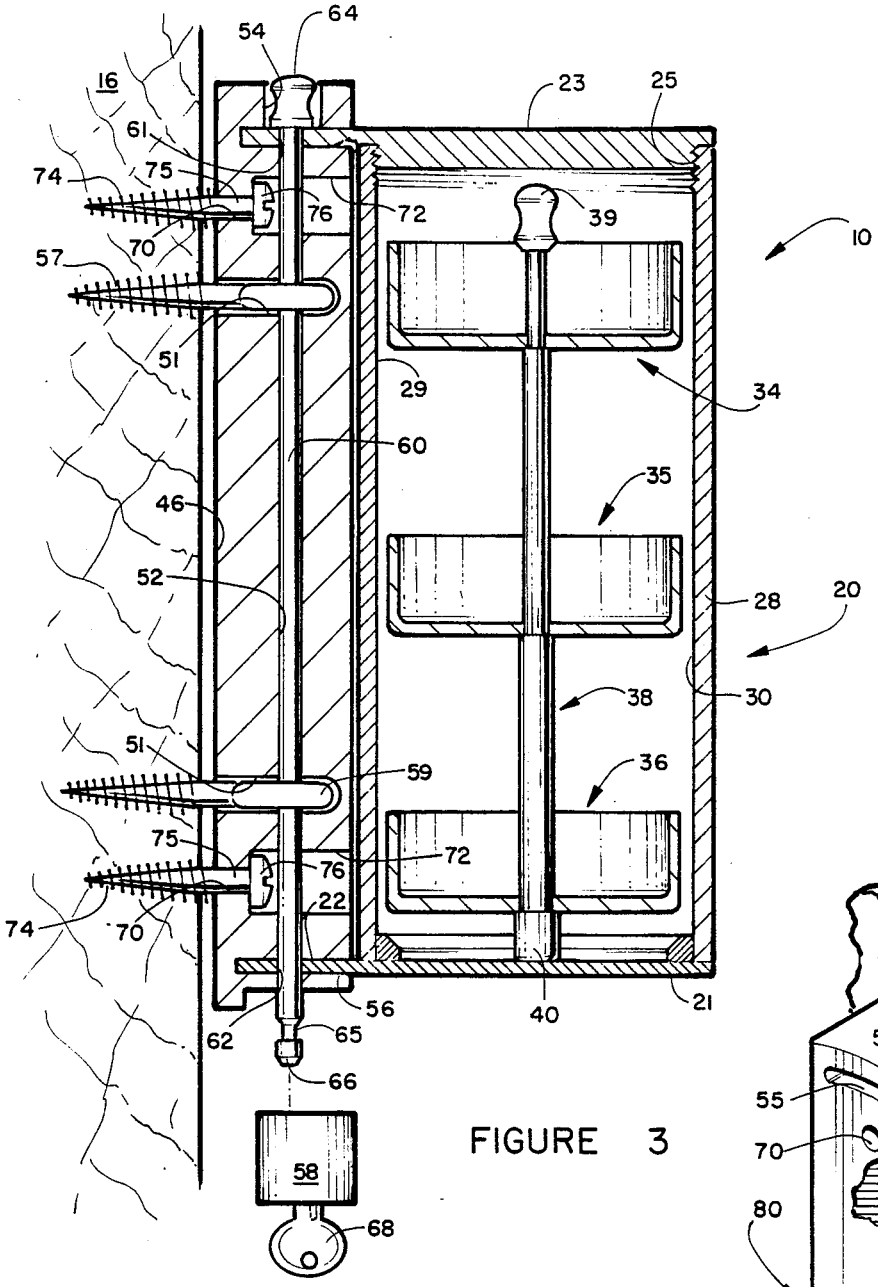
FIG. 3 is a cross sectional view illustrating the wall safe assembly in its installed position in the corner of a closet.
Figure 4:
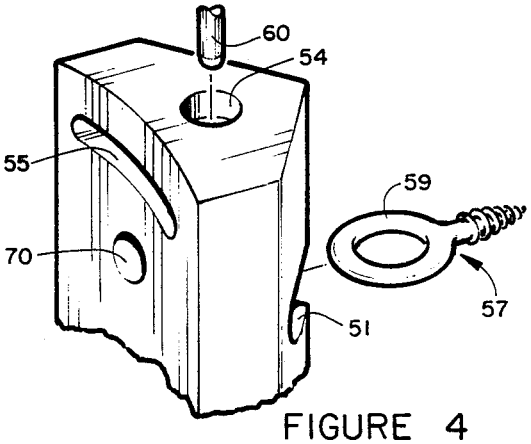
FIG. 4 is a partial front perspective view of the mounting block.

Applicant's novel wall safe assembly will not be described by referring to FIGS. 1–3 of the drawings. The wall safe assembly is generally designated numeral 10.

Wall safe assembly 10 would generally be mounted in a closet 12 having walls 13 and 14 made of sheets of drywall or paneling. Positioned behind these walls 13 and 14 at their corner are corner studs 16.

Generally the wall safe assembly 10 would be positioned adjacent the floor 18 of the closet.

The safe housing is designated numeral 20 and it has a bottom wall 21 and a cover or top wall 23. Ear members 22 and 24 extend laterally from the respective top and bottom wall members. Cover 23 has a threaded bottom exterior surface that mates with internal threads 25 at the top end of tubular safe housing 20. Bottom wall 21 could also be modified so that it would be threadably received in the bottom end of tubular safe housing if so desired. The main portion of safe housing 20 is a cylindrical sleeve 28 having a rear wall 29 and a storage chamber 30 is formed within the cylindrical sleeve. A tray assembly 32 has a plurality of trays 34, 35, and 36 that are mounted at spaced vertical positions on rod assembly 38. Top end cap 39 is located on the top end of rod assembly 38 and a bottom end cap 40 is located on the bottom end thereof.

Mounting block 44 is a solid member formed of metal having a front wall 45 and a rear wall 46. It also has side walls 47 and 48 and a top wall 49 and a bottom wall 50. A bore hole 52 extends from top wall 49 to bottom wall 50. Bore hole 52 is countersunk at 54. There are a pair of vertically spaced horizontal slots 55 in front wall 45.

Bottom wall 50 has a groove 56. A bore hole 52 extends from top wall 49 to bottom wall 50. The top end of bore hole 52 is countersunk at 54. Bottom wall 50 has a groove 56 which receives the top end of lock 58. A pair of vertically spaced eye lag slots 51 are formed in the rear wall 46 of mounting block 44 and they removably receive the ring portions 59 of six inch case hardened eye lags 57 (that have a four inch shank) that have been threaded into corner studs 16.

A locking rod 60 passes downwardly through aligned apertures 61 and 62 in the respective ear members 24 and 22 of safe housing 20. Lockng rod 60 also passes through the ring portons 59 of eye lags 57. Locking rod 60 has a head 64 formed on its top end and an annular groove 65 spaced upwardly from a knob 66 formed on its bottom end. The structure of annular groove 65 and knob 66 is designed to be captured in the top end of lock 58. Once safe housing 20 has been locked to mounting block 44 by locking rod 60 and lock 58, the only way it may be removed is with a key 68 to open the lock. The strength of the mounting system for the wall safe assembly is dependent upon the four inch eye lags.

Apertures 70 extend through mounting block 44 from front wall 45 to rear wall 46. Apertures 70 are countersunk at 72. Screws 74 having a shank portion 75 and a head 76 fasten mounting block 44 to corner stud 16. When safe housing 20 is secured to mounting block 44, the heads 76 of screws 74 are not visible or accessible.

Figure 5:
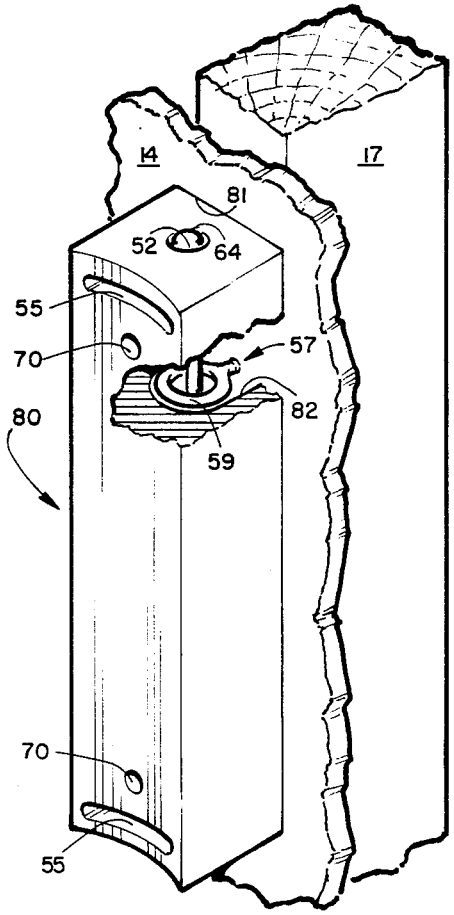
FIG. 5 is a front perspective of an alternative mounting block have portions broken away.

An alternative embodiment mounting block 80 is illustrated in FIG. 5. It would be mounted to a wall 14 having a stud 17 behind it. Rear wall 81 is entirely flat across its width and it has a pair of vertically spaced eye lag slots 82. The remainder of the structure of mounting block 80 is similar to that of mounting block 44 and identical members are used to identify its structure.

What is claimed:

1. A wall safe assembly comprising:

an elongated vertically oriented safe housing having a top wall and a bottom wall with upstanding side walls to form a chamber therein, one of said side walls being a front wall and another of said side walls being a rear wall;

an elongated vertically oriented mounting block which is a solid member having a front wall and a rear wall spaced a predetermined distance from each other, at least one eye lag slot extends through said rear wall into the interior of said mounting block for receiving the ring portion of an eye lag that has been threaded into the wall of a room;

eye lag fastening means for securing said mounting block to a wall, said eye lag fastening means being received in the eye lag slots that extend through said rear wall into the interior of said mounting block;

interlocking structural members extending rearwardly from the rear wall of said safe housing and mating recesses extending through said front wall into the interior of said mounting block detachably receiving said interlocking structural members, the interlocking structural members extending rearwardly from the rear of said safe housing are a pair of vertically spaced horizontally oriented ear members having aligned vertical apertures and said mating recesses are horizontal slots extending through the front wall and into the interior of said mounting block; and means for locking said interlocking structural members to said mounting block comprising a bore hole that passes downwardly through the interior of said mounting block which is aligned with the apertures in said ear members and also with said eye lag slots, a locking rod is removably inserted downwardly into said bore hole and it passes through the apertures in said ear members and through the ring portions of said eye lags.

2. A wall safe assembly as recited in claim 1 wherein the top wall of said safe housing is a removable cover.

3. A wall safe assembly as recited in claim 2 further comprising an elongated vertically oriented tray assembly that is removably received in said safe housing.

4. A wall safe assembly as recited in claim 2 wherein said safe housing has a cylindrical outer configuration.

5. A wall safe assembly as recited in claim 2 further comprising means for screwing said removable cover onto the top end of said safe housing.

6. A wall safe assembly as recited in claim 1 further comprising a lock for receiving the bottom end of said locking rod.

* * * * *